US009657556B2

(12) United States Patent
Tanner et al.

(10) Patent No.: US 9,657,556 B2
(45) Date of Patent: May 23, 2017

(54) METAL BELLOWS WITH GUIDE RINGS

(71) Applicant: Baker Hughes Incorporated, Houston, TX (US)

(72) Inventors: David Tanner, Broken Arrow, OK (US); Ryan P. Semple, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 250 days.

(21) Appl. No.: 14/543,179

(22) Filed: Nov. 17, 2014

(65) Prior Publication Data

US 2016/0138375 A1 May 19, 2016

(51) Int. Cl.

| | |
|---|---|
| ***E21B 43/12*** | (2006.01) |
| ***F04C 13/00*** | (2006.01) |
| ***F04C 15/00*** | (2006.01) |
| ***F04D 13/10*** | (2006.01) |
| ***F04D 29/08*** | (2006.01) |
| ***E21B 4/00*** | (2006.01) |
| *F04C 2/107* | (2006.01) |

(52) U.S. Cl.

CPC ..... *E21B 43/128* (2013.01); *E21B 4/003* (2013.01); *F04C 13/008* (2013.01); *F04C 15/008* (2013.01); *F04C 15/0034* (2013.01); *F04D 13/10* (2013.01); *F04D 29/086* (2013.01); *F04C 2/107* (2013.01)

(58) Field of Classification Search

CPC .... E21B 43/128; E21B 4/003; F04C 15/0034; F04C 15/008; F04C 13/008; F04C 2/107; F04D 13/10; F04D 29/086

See application file for complete search history.

(56) References Cited

U.S. PATENT DOCUMENTS

| | | | |
|---|---|---|---|
| 2,365,994 | A | 12/1944 | Ashton |
| 5,983,738 | A | 11/1999 | Delaisse |

(Continued)

FOREIGN PATENT DOCUMENTS

| | | |
|---|---|---|
| JP | 2-113139 | 4/1990 |
| JP | 2-195001 | 8/1990 |
| JP | 08-247752 A | 9/1996 |

OTHER PUBLICATIONS

PCT Search Report mailed Feb. 3, 2016—S.N. PCT/US2015/060797, Filed Nov. 16, 2015.

*Primary Examiner* — Brad Harcourt

(74) *Attorney, Agent, or Firm* — Bracewell LLP; James E. Bradley

(57) ABSTRACT

A well pump assembly has a pump driven by an electrical motor. A seal section reduces a pressure difference between a dielectric lubricant in the motor and a hydrostatic well fluid pressure. The seal section has a housing containing a guide tube concentric with the axis. Contractible and extensible inner and outer bellows surround the guide tube. An inner bellows guide ring is secured to the inner bellows between ends and has an inner surface with an inner diameter smaller than a minimum inner diameter of the inner bellows for sliding engagement with an outer surface of the guide tube as the inner bellows lengthens and contracts. The outer bellows has a guide ring secured between ends and having an outer surface with an outer diameter larger than a maximum outer diameter of the outer bellows for sliding engagement with an inner surface of the housing.

19 Claims, 4 Drawing Sheets

(56) References Cited

U.S. PATENT DOCUMENTS

| | | | | |
|---|---|---|---|---|
| 6,286,552 | B1 | 9/2001 | Shimbori et al. | |
| 6,851,935 | B2 | 2/2005 | Merrill et al. | |
| 7,520,735 | B2 | 4/2009 | Merrill et al. | |
| 7,654,315 | B2 | 2/2010 | Du | |
| 8,443,841 | B2 | 5/2013 | Wellner et al. | |
| 2005/0008514 | A1* | 1/2005 | Merrill | F04D 13/083 417/472 |
| 2013/0004344 | A1 | 1/2013 | McKinney | |

* cited by examiner

METAL BELLOWS WITH GUIDE RINGS

FIELD OF THE DISCLOSURE

This disclosure relates in general to electrical submersible well pumps and in particular to a seal section for equalizing internal motor lubricant pressure with the hydrostatic well fluid pressure, the seal section having a metal bellows with guide rings to reduce wear.

BACKGROUND

Electrical submersible pump assemblies (ESP) are commonly employed to pump well fluid from oil producing wells. A typical ESP has a pump driven by an electrical motor filled with a dielectric motor lubricant. A pressure equalizer or seal section cooperatively connects with the motor to reduce a pressure differential between the motor lubricant and well fluid on the exterior.

One type of seal section employs bellows, typically metal. The seal section has an inner axially extending guide tube located within a cylindrical housing. In one arrangement, an outer bellows has one end fixed to an end of the housing and another end free to float or move axially. An inner bellows of smaller outer diameter has a fixed end secured to an opposite end of the housing and a floating end fixed to the floating end of the outer bellows. When the hydrostatic pressure differs from the motor lubricant pressure, one of the bellows extends while the other contracts to equalize the motor lubricant pressure with the hydrostatic pressure. Extension and contraction may occur while running the ESP into the well. Extension and contraction also occurs as the motor lubricant heats and cools. Heating and cooling occurs each time the motor re-starts after being turned off.

The inner diameter of the corrugated flexible wall of the inner bellows will contact and slide along the guide tube during extension and contraction of the inner bellows. Similarly, the outer diameter of the corrugated flexible wall of the outer bellows will contact and slide along the inner surface of the housing during extension and contraction of the outer bellows. The sliding movement of the inner diameter portions of the inner bellows against the guide tube can cause wear of the thin corrugated wall. The sliding movement of the outer diameter portions of the outer bellows against the inner surface of the housing can cause wear of the thin corrugated wall of the outer bellows. As larger volume, longer inner and outer bellows are developed, the extent of the sliding, rubbing contact increases because the axial travel range of the floating ends increases. The wear of the thin metal of the inner and outer bellows can result in a reduced fatigue life.

SUMMARY

The well pump assembly disclosed herein has a pump driven by an electrical motor. A seal section is operatively coupled to the motor for reducing a pressure difference between dielectric lubricant in the Motor and hydrostatic well fluid pressure on an exterior of the motor. The seal section has a guide member having a longitudinal axis and a cylindrical guide surface. A bellows is coaxial with the guide member and has a flexible corrugated wall that is closely spaced to the guide surface. The corrugated wall moves axially relative to the guide surface when the bellows contracts and extends. A guide ring is secured to the wall of the bellows between ends of the bellows. The guide ring has a contacting surface protruding slightly from the wall and slidingly engaging the guide surface as the bellows contracts and extends.

A wear resistant element may be on at least one of the surfaces of the guide ring and the guide member to reduce friction and increase wear life. The wear resistant element may comprise a coating on at least one of the surfaces of the guide ring and the guide member. The wear resistant element may comprise an insert member of a hard, wear resistant material bonded to the guide ring.

A plurality of axially extending grooves may be formed in at least one of the surfaces of the guide ring and guide member, the grooves being circumferentially spaced apart from each other.

The bellows comprises at least two separate flexible corrugated wall segments. The guide ring joins and secures mating ends of the two segments together.

In an alternate embodiment, the guide ring has an intermediate portion, a first cylindrical extension protruding axially from the intermediate portion in one direction and a second cylindrical extension protruding axially from the intermediate portion in an opposite direction. The first and second cylindrical extensions have a diameter that differs from a diameter of the intermediate portion. The bellows comprises at least two separate flexible corrugated wall segments, each of the segments having an end that secures to the intermediate portion of the guide ring. Each of the segments has a corrugated portion of the wall extending alongside one of the cylindrical extensions. The contacting surface of the guide ring extends from a free end of one of the cylindrical extensions to a free end of another of the cylindrical extensions, defining a greater axial length for the contacting surface than the axial dimension of the intermediate portion.

The guide surface of the guide member may be located on an outer diameter of the guide member. In that instance, the wall of the bellows surrounds the guide surface, and the contacting surface of the guide ring protrudes inward from the wall of the bellows.

The guide surface may also be located on an inner diameter of the guide member. In that instance, the wall of the bellows is located within the inner diameter of the guide member. The contacting surface of the guide ring protrudes outward from the wall of the bellows.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 5:
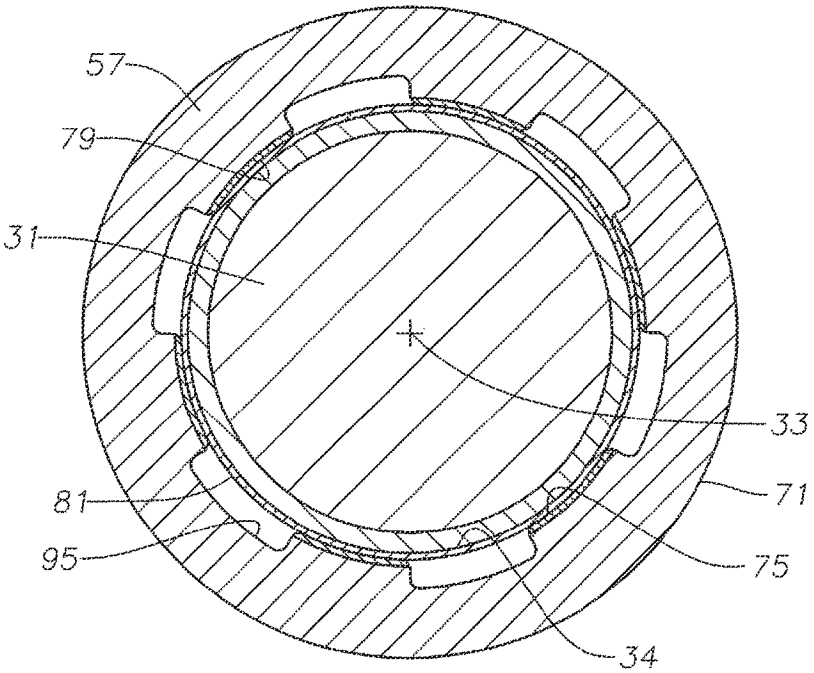
FIG. 5 is a transverse sectional view of a portion of the inner bellows and inner guide tube, taken along the line 5-5 of FIG. 3.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. The terms "upper", "lower" and the like are used only for convenience and not in a limiting manner.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
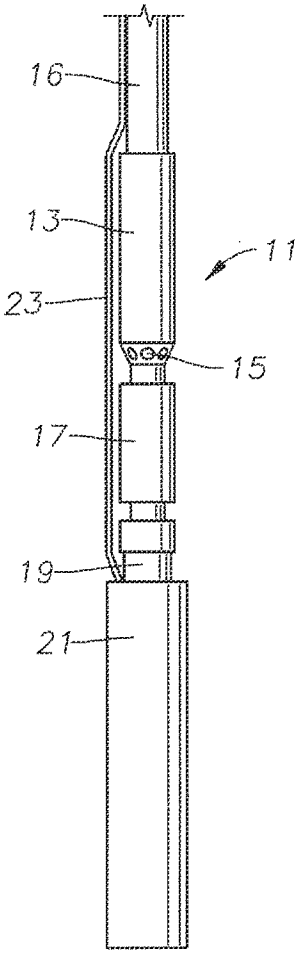
FIG. 1 is a side view of a well pump assembly in accordance with this disclosure.

Referring to FIG. 1, an electrical submersible pump assembly (ESP) 11 includes a pump 13 that may be a centrifugal type having a large number of stages, each stage having an impeller and a diffuser. Alternately, pump 13 may be another type, such as a progressing cavity pump. Pump 13 has an intake 15 for drawing in well fluid and pumping the fluid to a wellhead or production tree, normally through production tubing. 16. ESP 11 may be installed in a vertical portion or an inclined portion of a well, which may be horizontal.

ESP 11 has a seal section or pressure equalizer 17, a thrust bearing unit 19, and an electrical motor 21. Seal section 17 normally connects to pump intake 15; however, if a gas separator (not shown) is employed, pump intake 15 will be at the upstream end of the gas separator instead of the upstream end of pump 13. Thrust bearing unit 19 may be a separate module secured to seal section 17 or it may be located within an upstream end of seal section 17. Motor 21 usually connects to the lower end of seal section 17 or thrust bearing unit 19. Motor 21 rotates a shaft assembly (not shown in FIG. 1) that extends through thrust bearing unit 19 and seal section 17 into pump 13 to drive pump 13. Thrust bearing unit 19 accommodates axial thrust imposed on the shaft assembly. Although shown between motor 21 and pump 15, seal section 17 could alternately be mounted to the lower end of motor 21.

Motor 21 is typically a three-phase electrical motor supplied with power from a motor lead 23 at the lower end of a power cable extending to the wellhead. Motor 21 is filled with a dielectric motor lubricant for lubricating bearings within motor 21. The motor lubricant is in communication with thrust bearing 19 and part of seal section 17. Seal section 17 seals around the shaft assembly and reduces a pressure difference between the motor lubricant and the hydrostatic pressure of well fluid on the exterior of ESP 11. Pump 13, seal section 17, thrust bearing unit 19, and motor 21 may be connected together with bolted connections, with threaded collars, or other arrangements.

Figure 2:
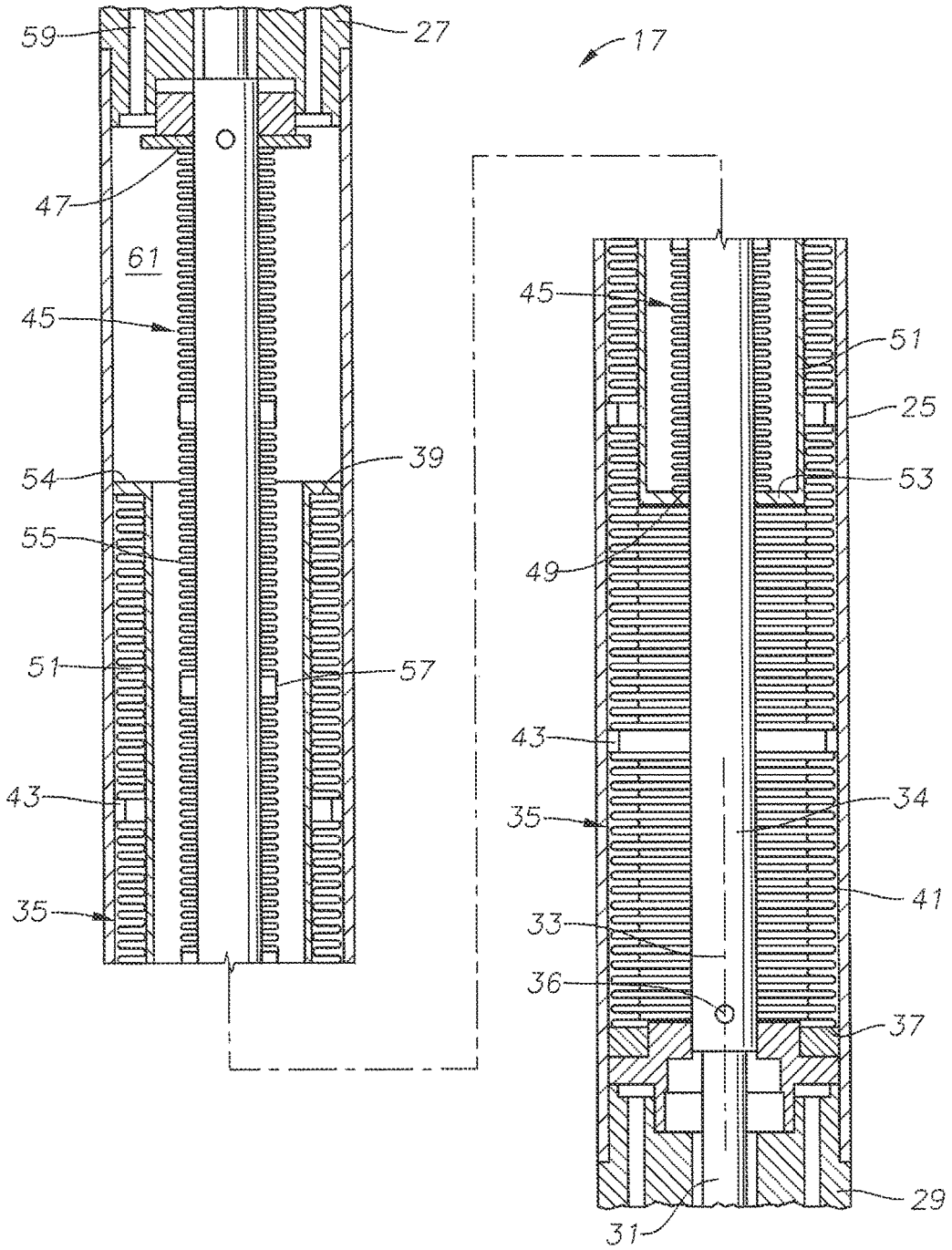
FIG. 2 is an enlarged, axial sectional view of the seal section of the pump assembly of FIG. 1.

Referring to FIG. 2, seal section 17 has an outer guide member or housing 25. Housing 25 is a cylindrical member having internally threaded ends. A pump end adapter 27 secures to one end, and a motor end adapter 29 secures to the opposite end. Pump end adapter 27 connects to pump intake 15 (FIG. 1), and motor end adapter 29 connects to thrust bearing unit 19, or directly to motor 21 if thrust bearing unit 19 is located within seal section 17. A rotatable drive shaft 31 extends through housing 25 and through adapters 27, 29 along a longitudinal axis 33. Bearings within adapters 27, 29 provide radial support for shaft 31 but do not seal. A main seal (not shown) on the pump end of shaft 31 at the upper end of pump end adapter 27 seals well fluid from entry around shaft 31 into seal section 17.

Shaft 31 is located within an inner guide tube 34 that extends from motor end adapter 29 to pump end adapter 27. Guide tube 34 does not rotate, rather serves to communicate motor lubricant from motor 21 (FIG. 1) into seal section 17. The lubricant flows through an annular space between guide tube 34 and shaft 31 and out one or more ports 36 of guide tube 34.

In this embodiment, seal section 17 has an outer bellows 35 located within housing 25 and surrounding guide tube 34. Outer bellows 35 is preferably metal and comprises a cylinder with a flexible corrugated wall. Outer bellows 35 has a fixed end 37 sealingly secured to one of the adapters, which in this embodiment comprises pump end adapter 27. Outer bellows 35 has a floating end 39 that moves axially within housing 25 when outer bellows 35 contracts and extends. Outer bellows 35 is made up of a number of corrugated wall segments 41 that are joined to each other to achieve the desired overall length of outer bellows 35. In this example, outer bellows 35 has four separate segments 41 but it could be more or less. Outer bellows guide rings 43 join the adjacent separate segments 41 to each other in a manner that will be explained in connection with FIG. 4.

Seal section 17 has an inner bellows 45 also located within housing 25 and surrounding guide tube 34. Inner bellows 45 is preferably metal and comprises a cylinder with a flexible corrugated wall of smaller outer diameter than an inner diameter of outer bellows 35. Inner bellows 45 has a fixed end 47 sealingly secured to the other adapter, which in this embodiment comprises motor end adapter 29. Inner bellows 45 has a floating end 49 that moves axially within housing 25 when inner bellows 45 contracts and extends.

Inner bellows floating end 49 is cooperatively joined to outer bellows floating end 39 for axial movement therewith. In this embodiment, a sleeve 51 joins floating ends 39 and 49 to each other. Sleeve 51 has an internal flange 53 at a lower end that sealingly secures to inner bellows floating end 49. Sleeve 51 has an external flange 54 at an upper end that sealing secures to outer bellows floating end 39. Sleeve 51 places the interiors of inner and outer bellows 45, 35 in fluid communication with each other for containing motor lubricant.

Inner bellows 45 is also made up of several separate segments 55. Inner bellows guide rings 57 sealingly join the separate segments 55. In this example, inner bellows 45 has four segments 55 joined by three guide rings 57, but the number could differ. The discussion of FIG. 3, below, explains inner bellows guide rings 57 in more detail.

Seal section 17 has a well fluid entry port 59 in pump end adapter 27 that admits well fluid into housing 25 on the outer sides of inner and outer bellows 45, 35. The well fluid will be located in a chamber 61 and in contact with the outer sides of inner and outer bellows 45, 35. The combined interior or volume of inner and outer bellows 45, 35 is initially filled with motor lubricant. Extension and contraction of inner and outer bellows 45, 35 reduces or equalizes the motor lubricant pressure with the hydrostatic well fluid pressure on the exterior of seal section 17. Also, over time, the volume of lubricant in inner and outer bellows 45, 35 may deplete.

Figure 3:
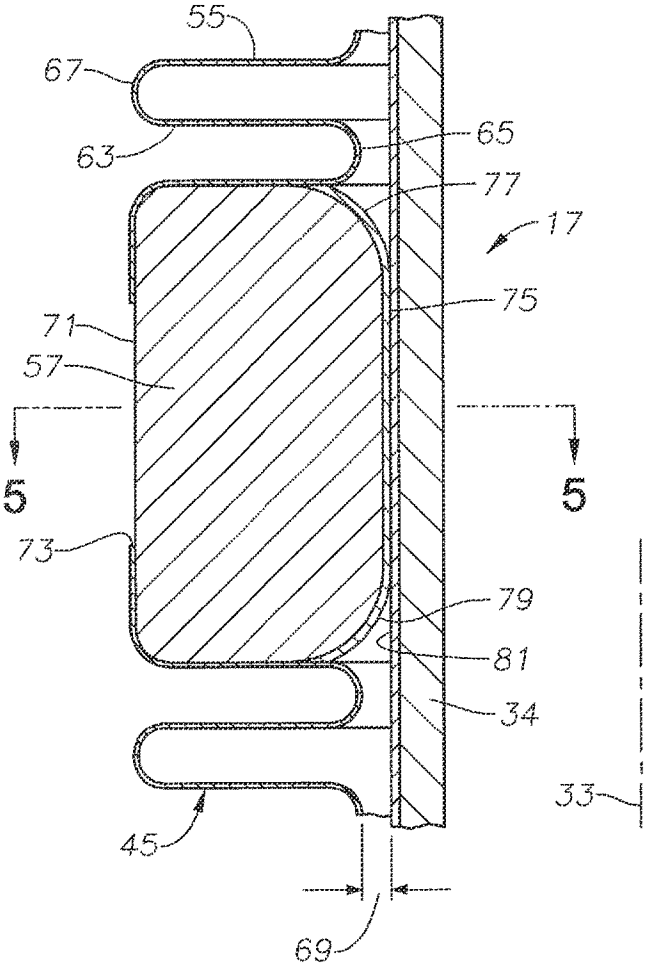
FIG. 3 is a further enlarged axial sectional view of a-portion of the inner bellows and inner guide tube of the seal section of FIG. 2.

Referring to FIG. 3, inner bellows 45 has a flexible corrugated wall 63 made up of folds, each fold having an inner bend 65 and an outer bend 67. Inner bends 65 are closer to guide tube 34 than outer bends 67. Each inner bend 65 is spaced a small amount from the outer diameter of guide tube 34 by about the same amount, defining an annular gap 69. Inner bends 65 define a minimum inner diameter for inner bellows 45. Each guide ring 57 has an outer diameter 71 that is approximately the outer diameter of inner bellows 45 measured at outer bends 67. Each inner bellows segment 55 has an end 73 that is sealingly joined to outer diameter 73 of one of the guide rings 57. The joiner may be by various conventional means. Ends 73 of adjacent segments 55 are axially spaced apart from each other a short distance.

Each inner bellows guide ring 57 has an inner diameter or contacting surface 75 that is smaller than the minimum inner diameter defined by inner bends 65. Thus each guide ring 57 protrudes radially inward past the effective inner diameter of corrugated wall 63, preferably by an amount slightly less than gap 69. The protrusion is sufficient for contacting surface 75 to substantially contact the outer diameter of guide tube 34, preventing the inner bends 65 of inner bellows guide ring 57 from contacting guide tube 34. A small clearance between contacting surface 75 and guide tube 34 will be provided for tolerances in the outer diameter of guide tube 34 and contacting surface 75 of guide ring 57. Guide rings 57 and guide tube 34 do not rotate relative to each other, but guide rings 57 do slide axially relative to guide tube 34 when inner bellows 45 extends and contracts.

Inner bellows guide rings 57 may have upper and lower corners 77 with a large radius to facilitate axial sliding on guide tube 34. Upper and lower corners 77 join inner contacting surface 75 with upper and lower ends of guide rings 57.

Motor lubricant will be located in the interior of inner bellows 45, thus will provide lubrication between contacting surfaces 75 and the outer surface of guide tube 34. However, a wear resistant element may be employed to increase the wear life between guide ring inner contacting surface 75 and guide tube 34. The wear resistant element may comprise a coating 79 on guide ring inner contacting surface 75, a coating 81 on the outer diameter of guide tube 34, or both, as shown. Coatings 79, 81 may be any suitable materials to enhance wear resistance, including hard, wear resistant materials and low friction materials. For example, coatings 79, 81 may comprise layers of tungsten carbide.

Figure 4:
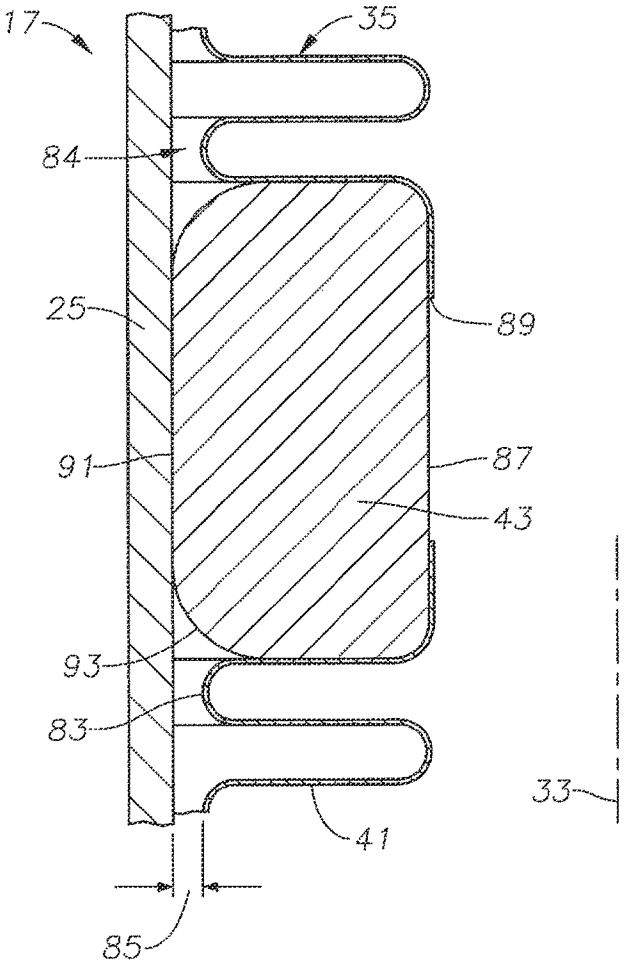
FIG. 4 is an axial sectional view of a portion of the outer bellows and housing of the seal section of FIG. 2.

Referring to FIG. 4, outer bellows 35 has an outer diameter defined by outer bends 83 of its corrugated, flexible wall. Outer bends 83 are spaced a short distance inward from inner diameter or guide surface 84 of housing 25, defining an annular gap 85. Each outer bellows guide ring 43 has an inner diameter 87 to which segment ends 89 of outer bellows segments 41 sealing join. Each outer bellows guide ring 43 has an outer diameter or contacting surface 91 that is larger in outer diameter than the outer diameter defined by outer bends 83. The difference is slightly less than outer gap 85, placing outer contacting surface 91 in substantial contact with housing inner diameter 84. A slight clearance exists between contacting surface 91 and guide surface 84 for tolerances. Each outer bellows guide ring 43 may have large radius corners 93 at junctions of outer diameter 91 at upper and lower ends, in a similar manner to corners 77 of inner bellows guide rings 57 (FIG. 3).

The protrusion of outer bellows guide rings 43 radially outward from the corrugated wall of outer bellows 35 prevents outer bends 83 from axially sliding against housing inner diameter 84 during expansion and contraction. The engagement of outer bellows guide ring contacting surfaces 91 with housing inner diameter 84 will be lubricated by well fluid. However, wear resistant elements such as coatings 79, 81 of inner bellows guide rings 57 and guide tube 34 may be employed.

Referring to FIG. 5, each inner bellows guide ring 57 is shown with optional axially extending grooves 95 spaced around its inner diameter. Grooves 95 extend from the upper to the lower end of guide ring 57 to facilitate flow of lubricant from below to above guide ring 57. Grooves 95 are spaced apart from each other around the inner circumference of guide ling 57. The spacing may be even, as shown. Grooves 95 thus result in the sliding inner contacting surface 75 of guide ring 57 to be formed in circumferential spaced apart sections, each section being part of a cylinder. Coating 79 is located on these circumferential sections. Alternately, grooves 95 could be formed on the outer diameter of guide tube 34. Similar grooves could be formed on the outer contacting surface 91 (FIG. 4) of outer bellows guide rings 43.

In operation, referring to FIG. 2, outer bellows 35 and inner bellows 45 of seal section 17 are filled with motor lubricant and in fluid communication with the motor lubricant in motor 21 (FIG. 1) via guide tube ports 36. When ESP 11 (FIG. 1) is lowered into well fluid in the well, hydrostatic well fluid pressure will enter chamber 61 and act on the exteriors of outer bellows 35 and inner bellows 45 (FIG. 2), causing outer bellows 35 to axially contract. Inner bellows 45 extends at the same time through the connection of floating ends 39 and 49, decreasing the total volume inside inner and outer bellows 45, 35. The hydrostatic pressure transmits through guide tube ports 36 and guide tube 34 to the motor lubricant in motor 21 (FIG. 1).

When reaching the desired depth, the operator turns on motor 21 to operate pump 13 (FIG. 1). Motor 21 heats the motor lubricant, causing it to expand. Also, higher well temperatures at the setting depth heat the motor lubricant. The expansion in volume of motor lubricant communicates through ports 36 of guide tube 34 to the motor lubricant in the interiors of outer bellows 35 and inner bellows 45. Outer bellows 35 axially extends and inner bellows 45 contracts as a result, increasing the volume inside inner and outer bellows 45, 35. Motor 21 may be shut down from time to time, and when that occurs, the motor lubricant cools and the motor oil volume shrinks, causing outer bellows to axially contract and inner bellows 45 to axially extend.

As outer bellows 35 contracts and inner bellows 45 extends, inner bellows guide rings 57 slide on guide tube 34. Outer bellows guide rings 43 slide on inner guide surface 84 of housing 25 at the same time. Similarly, the extension of outer bellows 35 and contraction of inner bellows 45 causes inner bellows guide rings 57 to slide on guide tube 34 and outer bellows guide rings 43 to slide on housing inner guide surface 84. During the axial sliding movement, inner bellows guide rings 57 prevent sliding contact of the inner diameter or inner bends 65 with guide tube 34, avoiding wear on the thin surfaces of inner bellows 45. Outer bellows guide rings 43 prevent sliding contact of the lower diameter or outer bends 83 with housing inner guide surface 84.

Figure 6:
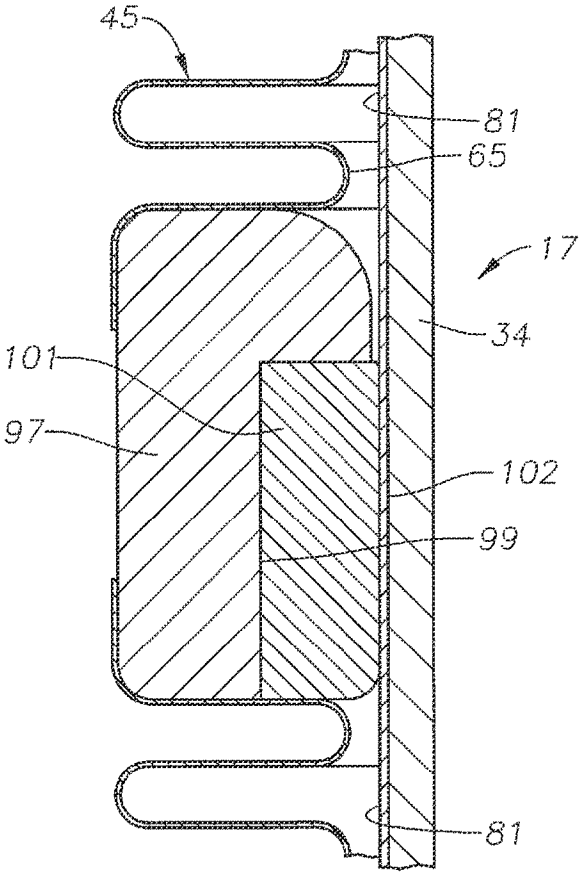
FIG. 6 is an axial sectional view of a portion of the inner bellows and the inner guide tube, showing an alternate embodiment to FIG. 3.

FIG. 6 illustrates an alternate to employing coating 79 (FIG. 3) on the inner contacting surface 75 of inner bellows guide ring 57, and a coating to outer bellows guide ring 43 (FIG. 4). The components that are the same as in FIG. 3 have the same reference numerals. Inner bellows guide ring 97 has a recess 99 formed in its inner diameter. A wear resistant insert 101 is secured in recess 99. Insert 101 has an inner contacting surface 102 that protrudes farther inward than inner bellows inner bends 65. Inner contacting surface 102 slidingly engages the outer surface of guide tube 34, which may or may not have a coating 81. If axial grooves 95 (FIG. 5) are desired, insert. 101 would comprise short sections spaced circumferentially apart by grooves 95. Otherwise, insert 101 may be a single ring. Recess 99 is illustrated as extending to the lower side of inner bellows guide ring 97, but recess 99 could be centered between the upper and lower ends or located at the upper end. Inserts 101 could also be employed for outer contacting surface 91 of outer bellows guide rings 43 (FIG. 4).

Figure 7:
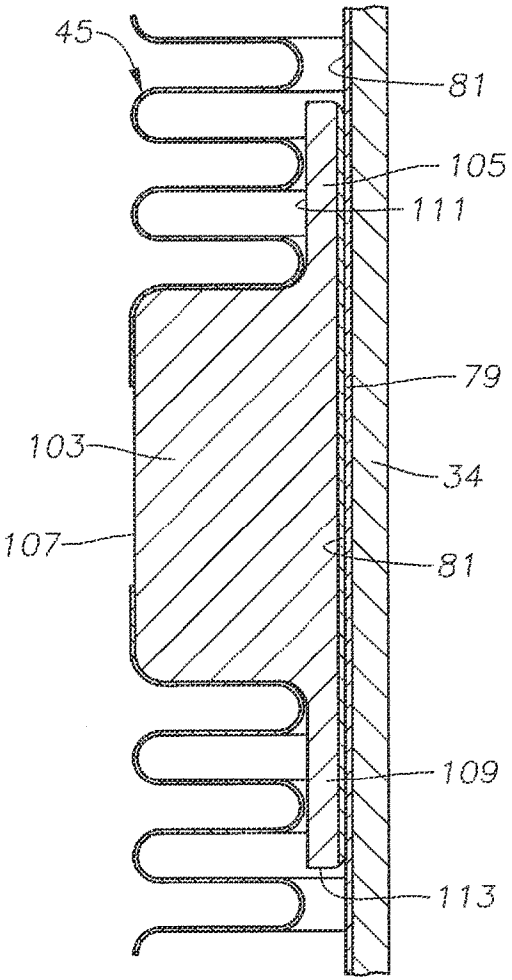
FIG. 7 is an axial sectional view of a portion of the inner bellows and the inner guide tube, showing another alternate embodiment to FIG. 3.

FIG. 7 discloses a second alternate embodiment to inner bellows guide ring 57 (FIG. 3) or outer bellows guide ring 43 (FIG. 4). The components that are the same as in FIG. 3 have the same reference numerals. Inner bellows guide ring 103 has an upper cylindrical extension 105 extending upward from an intermediate portion 107. A lower cylindrical extension 109 extends downward from intermediate portion 107. Upper and lower extensions 105, 109 have smaller outer diameters 111 than the outer diameter of intermediate portion 107, but the inner diameters of intermediate portion 107 and upper and lower extensions 105, 109 are the same. Inner bellows segment ends 73 fit over and are bonded to the outer diameter of intermediate portion 107. A portion of each inner bellows segment 55 adjacent segment ends 73 fits around one of the extensions 105, 109. Each extension 105, 109 thus fits within a portion of the inner diameter of inner bellows 45. The example of FIG. 7 shows two of the inner bends 65 extending around each extension 105, 109.

Each extension 105, 109 has a free end 113. The length of guide member 103 measured from the upper free end 113 to the lower free end 113 is longer than the axial length of intermediate portion 107. Coatings 79, 81 optionally may be placed on the inner surfaces of intermediate portion 107 and upper and lower extensions 105, 109. Axial grooves, such as grooves 95 are feasible. Cylindrical extensions could also be employed with outer bellows guide rings 43 (FIG. 4), except they would be on an outer diameter of an intermediate portion rather than an inner diameter.

While shown in only a few of its forms, it should be apparent to those skilled in the art that the disclosure is not limited to the embodiments shown. For example, the outward protrusion of outer bellows guide rings may not be needed in some instances. The wear resistant elements such as the coatings or inserts may not be required in some instances. The arrangement of outer bellows and inner bellows can differ.

The invention claimed is:

1. A well pump assembly for pumping well fluid from a well, comprising:

a pump;

an electrical motor operatively coupled to the pump for driving the pump;

a seal section operatively coupled to the motor for reducing a pressure difference between a dielectric lubricant in the motor and a hydrostatic well fluid pressure on an exterior of the motor, the seal section comprising:

a housing having a longitudinal axis and a cylindrical inner surface;

first and second end members at opposite ends of the housing;

a guide tube concentric with the axis and fixed between the end members;

an outer bellows within the housing surrounding the guide tube, the outer bellows having a fixed end secured to the first end member and a floating end that moves axially relative to the fixed end, and the outer bellows having a flexible corrugated wall that is closely spaced to the inner surface of the housing and moves axially relative to the housing when the outer bellows contracts and extends;

a sleeve within the outer bellows, the sleeve having an external flange secured to the floating end of the outer bellows and an internal flange located within the outer bellows;

an inner bellows surrounding the guide tube, the inner bellows having a fixed end secured to the second end member and a floating end located within the outer bellows and secured to the internal flange;

a guide ring secured to the wall of the outer bellows between the fixed and floating ends of the outer bellows, the guide ring having a contacting surface protruding slightly from the wall and slidingly engaging the inner surface of the housing as the outer bellows contracts and extends; and wherein the guide ring has an inner diameter that is larger than an outer diameter of the sleeve.

2. The assembly according to claim 1, wherein:

the inner diameter of the guide ring is greater than an inner diameter of the wall of the outer bellows.

3. The assembly according to claim 1, further comprising:

a coating on contacting surface of the guide ring to reduce friction and increase wear life.

4. The assembly according to claim 1, wherein:

the contacting surface of the guide ring comprises an insert member of a hard, wear resistant material secured to the guide ring.

5. The assembly according to claim 1, further comprising:

a plurality of axially extending grooves formed in contacting surface of the guide ring, the grooves being circumferentially spaced apart from each other.

6. The assembly according to claim 1, wherein:

the outer bellows comprises at least two separate flexible corrugated wall segments; and the guide ring joins and secures mating ends of the two segments together.

7. The assembly according to claim 1, wherein:

the guide ring has an intermediate portion, a first cylindrical extension protruding axially from the intermediate portion in one direction and a second cylindrical extension protruding axially from the intermediate portion in an opposite direction;

the outer bellows comprises at least two separate flexible corrugated wall segments, each of the segments having an end that secures to the intermediate portion of the guide ring;

each of the segments have a corrugated portion of the wall extending alongside one of the cylindrical extensions; and wherein the contacting surface of the guide ring extends from a free end of one of the cylindrical extensions to a free end of another of the cylindrical extensions, defining a greater axial length for the contacting surface than an axial dimension of the intermediate portion.

8. The assembly according to claim 1, wherein:

the guide ring is located between the outer diameter of the sleeve and the inner surface of the housing.

9. A well pump assembly for pumping well fluid from a well, comprising:

a pump;

an electrical motor operatively coupled to the pump for driving the pump;

a seal section operatively coupled to the motor for reducing a pressure difference between a dielectric lubricant in the motor and a hydrostatic well fluid pressure on an exterior of the motor, the seal section comprising:

a guide tube having a longitudinal axis and an outer cylindrical guide surface;

an inner and an outer bellows surrounding the guide tube, each of the inner and outer bellows having a flexible corrugated wall that allows axial contraction and extension, the inner bellows having a smaller outer diameter than an inner diameter of the outer bellows; and a guide ring secured to the corrugated wall of the inner bellows between opposite ends of the inner bellows, the guide ring having a contacting surface protruding inward from the corrugated wall of the inner bellows, the contacting surface slidingly engaging the guide surface as the inner bellows contracts and extends to prevent contact of the corrugated wall of the inner bellows with the guide surface.

10. The assembly according to claim 9, further comprising a wear resistant coating on the contacting surface of the guide ring.

11. The assembly according to claim 9, wherein the contacting surface of the guide ring comprises:

an insert member of a hard, wear resistant material secured to the guide ring.

12. The assembly according to claim 9, further comprising:

a plurality of axially extending grooves formed in the contacting surface of the guide ring, the grooves being circumferentially spaced apart from each other.

13. The assembly according to claim 9, wherein:

the corrugated wall of the inner bellows comprises at least two separate corrugated wall segments; and the guide ring joins and secures mating ends of the two segments together.

14. The assembly according to claim 9, wherein:

the guide ring has an intermediate portion, a first cylindrical extension protruding axially from the intermediate portion in one direction and a second cylindrical extension protruding axially from the intermediate portion in an opposite direction, the first and second cylindrical extensions having an outer diameter less than an outer diameter of the intermediate portion;

the corrugated wall of the bellows comprises at least two separate corrugated wall segments, each of the segments having a portion that extends around one of the cylindrical extensions, each of the segments having an end secured to the outer diameter of the intermediate portion; and wherein the contacting surface extends from a free end of one of the cylindrical extensions to a free end of the other of the cylindrical extensions, defining a greater axial length for the contacting surface than an axial dimension of the intermediate portion.

15. A well pump assembly for pumping well fluid from a well, comprising:

a pump;

an electrical motor operatively coupled to the pump for driving the pump;

a seal section operatively coupled to the motor for reducing a pressure difference between a dielectric lubricant in the motor and a hydrostatic well fluid pressure on an exterior of the motor, the seal section comprising:

a housing having a longitudinal axis;

first and second end members at opposite ends of the housing;

a guide tube concentric with the axis and fixed between the end members;

an outer bellows within the housing surrounding the guide tube, the outer bellows having a fixed end secured to the first end member and a floating end that moves axially relative to the fixed end;

an inner bellows surrounding the guide tube, having a fixed end secured to the second end member and a floating end located within the outer bellows, the floating end of the inner bellows being operatively connected with the floating end of the outer bellows for movement in unison;

an inner bellows guide ring secured to the inner bellows between the fixed end and the floating end of the inner bellows, the inner bellows guide ring having an inner surface with an inner diameter smaller than a minimum inner diameter of the inner bellows for sliding engagement with an outer surface of the guide tube as the inner bellows lengthens and contracts; and an outer bellows guide ring secured to the outer bellows between the fixed end and the floating end of the outer bellows, the outer bellows guide ring having an outer surface with an outer diameter larger than a maximum outer diameter of the outer bellows for sliding engagement with an inner surface of the housing as the outer bellows lengthens and contracts.

16. The assembly according to claim 15, wherein:

the inner bellows comprises at least two separate corrugated wall segments; and the inner bellows guide ring joins and secures mating ends of the two segments of the inner bellows together.

17. The assembly according to claim 15, wherein:

the outer bellows comprises at least two separate corrugated wall segments; and the outer bellows guide ring joins and secures mating ends of the two segments of the outer bellows together.

18. The assembly according to claim 15, further comprising:

an inner guide ring wear resistant element on the inner surface of the inner bellows guide ring to reduce friction and increase wear life; and an outer guide ring wear resistant element on the outer surface of the outer guide ring to reduce friction and increase wear life.

19. The assembly according to claim 15, further comprising:

a plurality of axially extending grooves formed in the inner surface of the inner bellows guide ring and circumferentially spaced apart from each other.

* * * * *